United States Patent [19]

Johnson

[11] 4,182,305

[45] Jan. 8, 1980

[54] APOLLO MODEL FIREPLACE

[75] Inventor: William R. Johnson, Santa Cruz, Calif.

[73] Assignee: Chinook Manufacturing Co., Santa Cruz, Calif.

[21] Appl. No.: 858,627

[22] Filed: Dec. 8, 1977

[51] Int. Cl.[2] ..... F24B 1/18

[52] U.S. Cl. ..... 126/120; 126/121; 126/143; D23/97

[58] Field of Search ..... 126/120, 121, 143, 129, 126/131; D23/97

[56] References Cited

U.S. PATENT DOCUMENTS

| | | | |
|---|---|---|---|
| 3,339,540 | 9/1967 | Kreider | 126/121 |
| 3,499,432 | 3/1970 | Hannebaum | 126/120 |
| 3,910,251 | 10/1975 | Andrew | D23/97 |
| 4,026,263 | 5/1977 | Boyd | 126/121 |
| 4,112,913 | 9/1978 | Shimek et al. | 126/120 |

OTHER PUBLICATIONS

Space-Planner Co. Inc., AIA File No. 14-E-5, 316 South Norris Ave., P.O. Box 1191, Tucson, Arizona.

*Primary Examiner*—John J. Camby
*Assistant Examiner*—Larry I. Schwartz
*Attorney, Agent, or Firm*—Robert G. Slick

[57] ABSTRACT

A metal fireplace unit suitable for use in mobile homes or the like is formed in the configuration of an eight-sided space capsule. Heat resistant windows are placed on three of the eight sides so that the fireplace presents an attractive appearance when viewed from almost any angle. An efficient heat circulating system is employed so that a maximum amount of heat is extracted from the fuel.

4 Claims, 4 Drawing Figures

APOLLO MODEL FIREPLACE

SUMMARY OF THE INVENTION

The present invention relates to a modular metal fireplace which can be installed as a unit in a given location, such as a mobile home.

The body of the fireplace is formed in the configuration of an eight-sided space capsule so that it has a modern and attractive appearance.

Heat resistant glass windows or doors are provided on three of the eight sides so that the fire is visible over a wide angle of view. Thus, if the fireplace is placed either in the corner or a wall of a room, the fire is visible from the entire room, providing an attractive and cheerful appearance.

The fireplace is provided with an elevated base through which combustion air circulates, keeping the base cool so that the fireplace can be set directly upon a rug or even a wooden floor without the necessity of providing a protective covering on the floor.

The firebox proper is made of stainless steel and is separated from the shell of the fireplace with means for circulating air between the shell and the firebox so that the fireplace is very efficient in utilizing fuel.

Various other features and advantages of the invention will be brought out in the balance of the specification.

DESCRIPTION OF THE PREFERRED EMBODIMENTS

Figure 1:
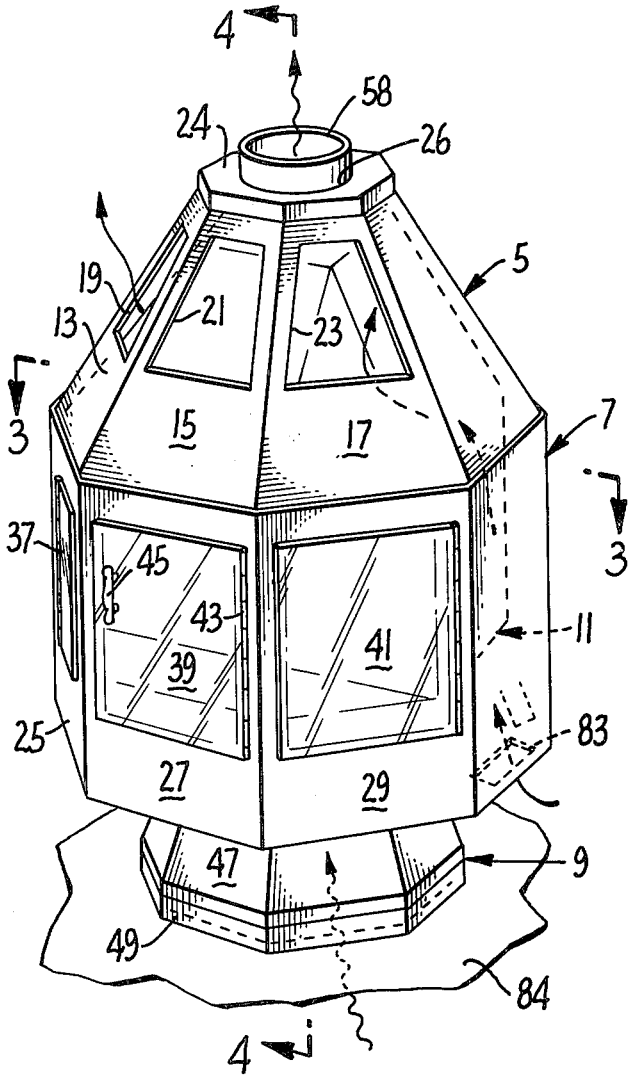
FIG. 1 is a perspective view of a fireplace embodying the present invention.
Figure 2:
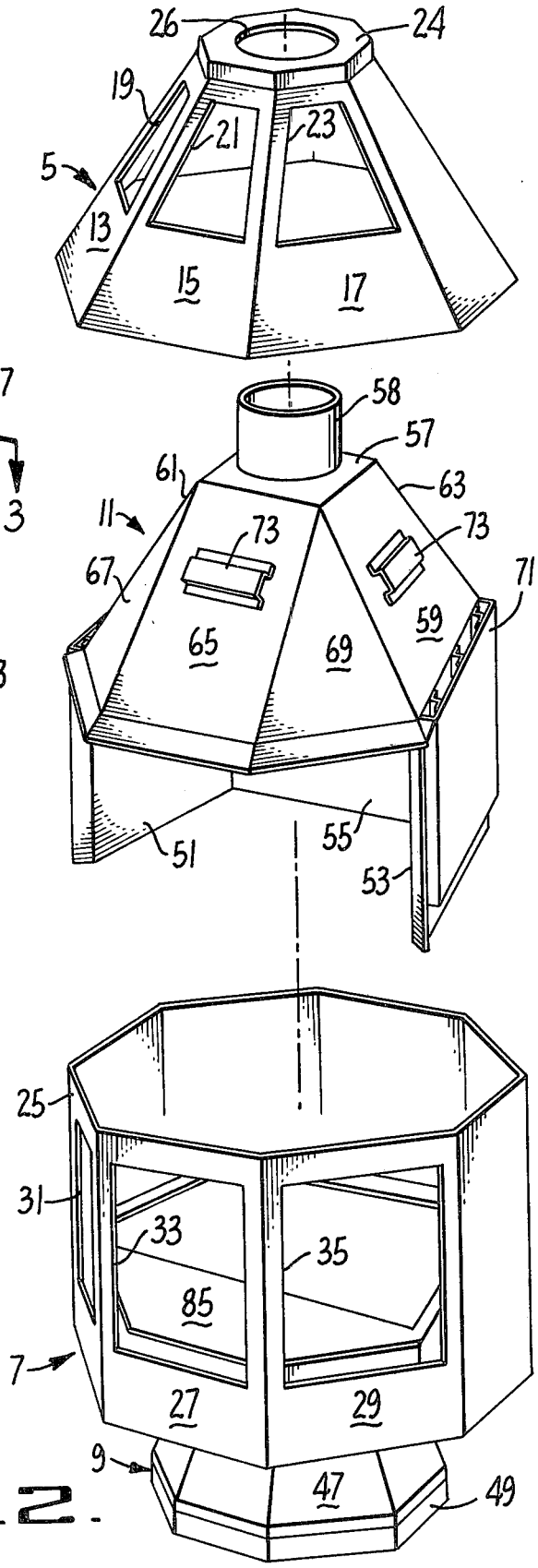
FIG. 2 is an exploded view of the main components of the fireplace.

The fireplace of the present invention includes four main components, namely a top shell 5, a body shell 7, a base 9 and a firebox 11 which fits within the space formed inside the top shell 5 and the body shell 7.

The top shell 5 is generally pyramidal in shape and has eight walls in the form of trapezoids. Three of the walls designated 13, 15 and 17 have cut-out openings designated 19, 21 and 23. These openings are for the escape of heat and may or may not be covered by a suitable grill. The other five walls may or may not have openings for the escape of heat. The walls are joined at the sides and by the top 24 which has a center round opening 26.

The body shell 7 is made of eight rectangular pieces joined as an octagon and three of the walls, namely 25, 27 and 29 have rectangular openings 31, 33 and 35. These openings are covered by heat-resistant glass 37, 39 and 41 and at least the center 39 is provided with hinges 43 so that one can tend the fire in the usual manner. All three pieces of heat resistant glass may be hinged although it is usual to hinge only the center one. The center glass is ordinarily provided with a suitable handle 45 for opening and closing the door.

The base is composed of eight trapezoidal sections, a typical section being designated 47. These sections rest on a bottom member 49 and the space within the bottom and base is hollow for the introduction of combustion air as is later explained in detail.

Figure 3:
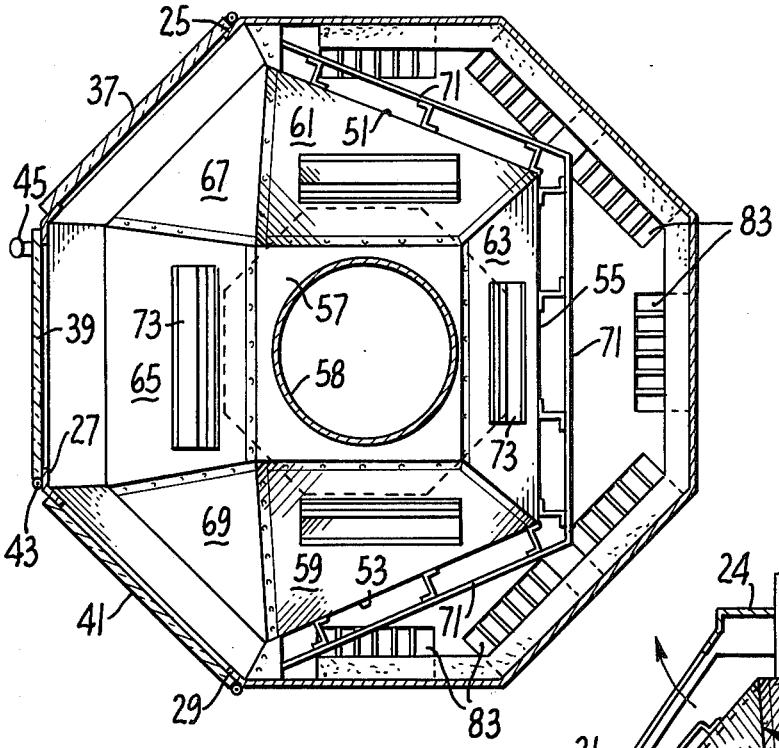
FIG. 3 is a section on the line 3—3 of FIG. 1.
Figure 4:
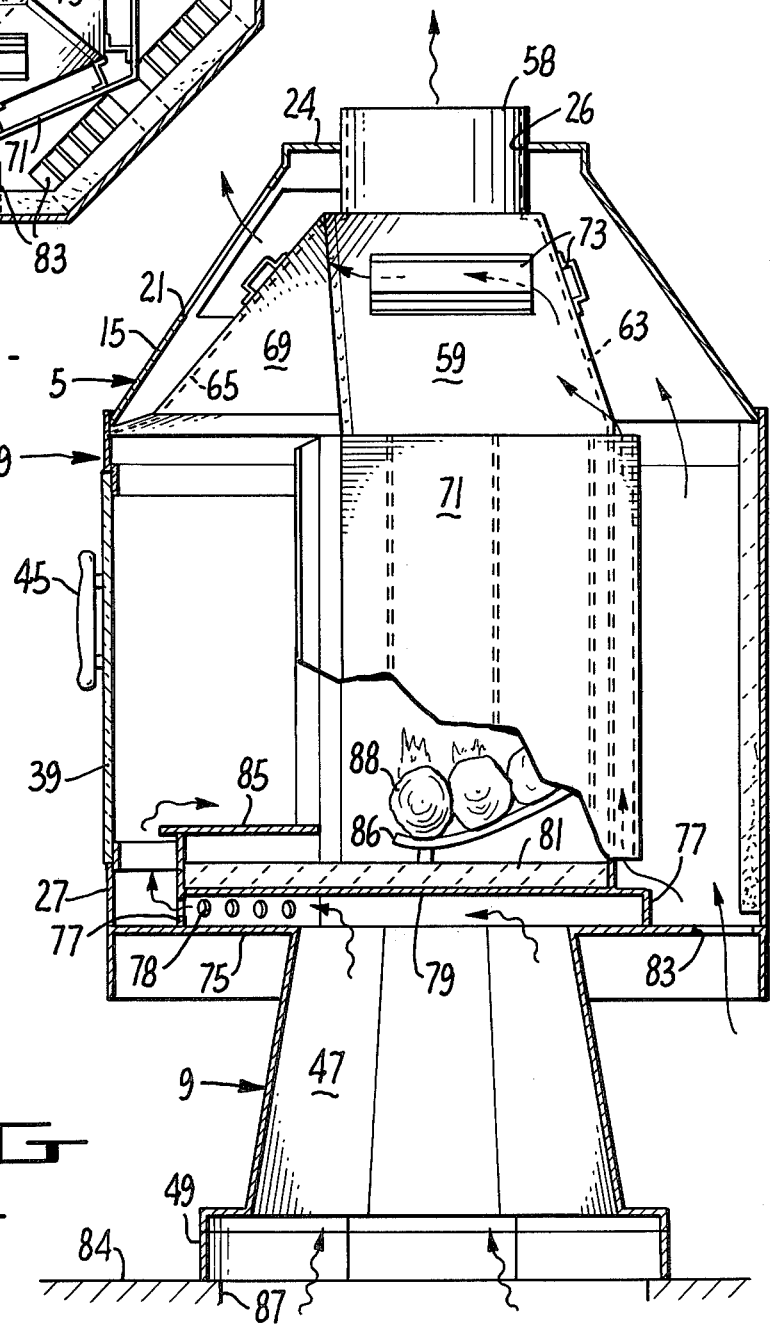
FIG. 4 is a section on the line 4—4 of FIG. 1.

The firebox 11, which is preferably constructed of stainless steel, has side members 51 and 53 and a back member 55. A cap member 57 has four sides which are joined to the side sections by means of the trapezoidal top sections 59 and 61 and the back member 63. The top member 57 also connects to the front member 65 which is joined to the side and top members by the triangular sections 67 and 69. Preferably the sides and back are provided with baffle members 71 which serve to stiffen the firebox and also to prevent the sides of the body of the fireplace from getting too hot. As can best be seen in FIG. 3, the side members 61 and 59 abut the junction of the panels 25 and 29. The firebox forms a tight seal with the outer shell so that the combustion products cannot mix with the room air. The top members are preferably provided with stiffening flanges such as at 73.

The body shell is provided with a bottom wall 75 which joins the bottom base 9. This bottom wall has uprights 77 which support the hearth 79 which has fire brick 81 thereon. The member 77 has a number of openings 78 where combustion air can be drawn from the base. Air from the room is drawn through openings 83 and circulated between the firebox and the outer shell and discharged through the openings 19, 21 and 23. The front of the firebox has an ash stop 85 of metal. Andirons 86 support logs 88 (real or artificial) within the firebox.

The fireplace of the present invention is designed to sit on a floor 84 which has a hole 87 therein so that combustion air can enter from the outside of the room, pass up through the hollow base 9, out through the holes 78 and into the firebox and smoke will be discharged through the pipe 58. Naturally the pipe 58 will be connected to a conventional chimney structure, not illustrated. Air from the room will be drawn in through the openings 83 and pass around the firebox and be discharged from the top openings 19, 21 and 23.

It is believed apparent from the foregoing that I have provided an attractive fireplace of modern appearance wherein the fire can be viewed from any place in the room and which is very efficient in utilizing fuel.

I claim:

1. A metal fireplace comprising in combination:

a. body portion of octagonal configuration formed by eight generally rectangular body panels, b. eight converging top panels of trapezoidal shape attached to the tops of said side members, c. an elevated base member supporting said body panels, d. at least three of said adjacent body panels having transparent, heat-resisting glass therein, e. vent members in at least those of said top panels lying over each of the glass sections, f. a firebox within said body portion, g. a hearth extending forward from the firebox, directly behind and below the body panels of paragraph d, h. said base member being of octagonal configuration and being hollow whereby air can pass through base member, said base member having a central opening under the center of said firebox, i. a passageway for combustion air from said central opening through a space under said firebox, j. an opening from said space under the said firebox at the front of said fireplace whereby combustion air can pass upwardly through said hollow base, pass under said firebox through the space provided, to the front of the firebox, and a passage from said front over said hearth and into said firebox.

2. The structure of claim 1 wherein said firebox is formed with three sides separated from five adjacent body panels and sealed to the sides of said body member opposite said three members having glass therein whereby one can see into the firebox from all of the three glass members.

3. The structure of claim 2 having an air space between said firebox and said five panel members and means for circulating air through said space to warm the same.

4. The structure of claim 2 wherein said firebox is made of stainless steel.

* * * * *